US006832600B2

(12) United States Patent
Winter

(10) Patent No.: US 6,832,600 B2
(45) Date of Patent: Dec. 21, 2004

(54) FUEL INJECTION VALVE FOR INTERNAL COMBUSTION ENGINES

(75) Inventor: Joachim Winter, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,714

(22) PCT Filed: Mar. 23, 2002

(86) PCT No.: PCT/DE02/01080

§ 371 (c)(1),
(2), (4) Date: Jul. 14, 2003

(87) PCT Pub. No.: WO02/097261

PCT Pub. Date: Dec. 5, 2002

(65) Prior Publication Data

US 2004/0050972 A1 Mar. 18, 2004

(30) Foreign Application Priority Data

May 29, 2001 (DE) ..... 101 25 943

(51) Int. Cl.[7] ..... F02M 37/04
(52) U.S. Cl. ..... 123/470; 123/198 D
(58) Field of Search ..... 123/470, 198 D, 123/41.31, 509, 468, 469, 456; 239/600, 533.1–533.12, 552, 585.1–585.5; 138/137

(56) References Cited

U.S. PATENT DOCUMENTS

| | | | | | |
|---|---|---|---|---|---|
| 3,841,277 | A | * | 10/1974 | Schafer | 123/470 |
| 4,773,374 | A | * | 9/1988 | Kiuchi et al. | 123/470 |
| 5,685,485 | A | * | 11/1997 | Mock et al. | 239/102.2 |
| 6,027,047 | A | * | 2/2000 | Augustin | 239/533.3 |
| 6,183,212 | B1 | * | 2/2001 | Djordjevic | 417/273 |
| 6,378,562 | B1 | * | 4/2002 | Noone et al. | 138/137 |
| 6,758,408 | B2 | * | 7/2004 | Czimmek | 239/5 |

FOREIGN PATENT DOCUMENTS

DE 3012416 * 10/1981

* cited by examiner

*Primary Examiner*—Carl S. Miller
(74) *Attorney, Agent, or Firm*—Ronald E. Greigg

(57) ABSTRACT

A fuel injection valve for internal combustion engines, having a valve body with longitudinal bore terminating in a valve seat. In the region of the valve seat, at least one injection opening connects the bore with the combustion chamber of the engine. A valve member disposed in the bore cooperates with the valve seat for controlling the at least one injection opening. Between the wall of the bore and the valve member, a pressure chamber is embodied that can be filled with fuel at high pressure. The valve body is surrounded, in the region of the pressure chamber, by a sleeve that has anisotropic strength properties, so that the valve body exhibits less deformation from the pressure in the pressure chamber.

10 Claims, 2 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 02/01080 filed on Mar. 23, 2002.

BACKGROUND OF THE INVENTION

FIELD OF THE INVENTION

The invention is directed to an improved fuel injection valve for internal combustion engines.

DESCRIPTION OF THE PRIOR ART

One fuel injection valve of this type with which this invention is concerned is known from German Patent Disclosure DE 196 18 650 A1, for instance. Such a fuel injection valve has a valve body, in which a bore with a longitudinal axis is embodied, and a valve seat is embodied on the end of the bore toward the combustion chamber. In the region of the valve seat there is at least one injection opening in the valve body that connects the bore with the combustion chamber of the engine. In the bore, a valve member is disposed longitudinally displaceably, being guided in a portion of the bore remote from the combustion chamber. On the end toward the combustion chamber, the valve member changes into a sealing face, which cooperates with the valve seat and thus controls the at least one injection opening. Between the valve member and the wall of the bore, a pressure chamber is formed that can be filled with fuel at high pressure. Because of the fuel pressure in the pressure chamber, the valve member moves counter to a closing force, so that depending on the ratio between the closing force and the hydraulic force on the valve member, the injection opening is opened or closed. The known fuel injection valve has the disadvantage, however, that because of the fuel, which is introduced into the valve body at very high pressure, deformation of the pressure chamber and hence bulging out of the valve body occurs. This has effects especially on the points where the valve member touches the valve body, that is, on the one hand the guided portion of the valve member and on the other the valve seat. As a result of the deformation of the valve body in the region of the pressure chamber, which essentially takes the form of a radial widening of the valve body, the play between the valve member and the valve body can be altered in the region of the guidance. This can lead to increased wear and hence a shorter service life of the fuel injection valve. Moreover, the valve seat, which is embodied essentially conically, tilts outward somewhat because of the widening. This tilting is unwanted, since it affects the opening pressure, that is, the pressure in the pressure chamber at which the valve member moves counter to the closing force, and increases wear in the region of the valve seat.

SUMMARY OF THE INVENTION

The fuel injection valve of the invention has the advantage over the prior art that the strength of the valve body is increased, so that the deformation of the valve body caused the pressure in the pressure chamber is reduced. To that end, the valve body is surrounded, in the region of the pressure chamber, by a sleeve that has anisotropic strength properties. As a result, the tangential stiffness of the valve body can be increased, and thus the disadvantages resulting from deformation of the valve body because of the high fuel pressure in the pressure chamber are avoided.

In an advantageous embodiment of the sleeve, this sleeve has a greater tensile strength in the tangential direction, relative to the longitudinal axis of the bore, than in the longitudinal direction. Since the deformation of the valve body under pressure occurs primarily in the radial direction, reinforcing the valve body in the tangential direction suffices to achieve the desired stiffness.

In an advantageous feature, the sleeve has a greater modulus of elasticity in the tangential direction than the steel from which the valve body is made. As a result, part of the valve body can be replaced by the sleeve, so that the total outer dimensions of the valve body are increased only insignificantly, if at all, as a result of the sleeve.

In an advantageous feature, the sleeve contains fibers, at least some of which extend at least approximately in the tangential direction. Such composite materials that contain fibers can be manufactured with their strength properties directionally dependent in a targeted way, so that their strength properties can be adjusted over wide ranges.

In a further advantageous feature, the fiber are embodied as carbon fibers. Such carbon fibers are extremely tear-resistant in their longitudinal direction and have a high modulus of elasticity, so that moduli of elasticity and tensile strengths are achievable that are markedly higher than those of steel.

In another advantageous feature, the carbon fibers are embodied in a matrix of epoxy resin. Such carbon-fiber and epoxy-resin composite materials are well known from the prior art and can thus be put into any arbitrary shape using known techniques.

Epoxy resin here is a thermosetting plastic, so that no flowing of the material occurs under the influence of temperature.

In another advantageous feature, the carbon fibers are embodied in a matrix of graphite. A carbon-fiber and graphite composite has the advantage of remaining stable up to high temperatures of 200° C. to 300° C. and of thus being suited without limitation for use in a fuel injection valve.

In another advantageous feature, the carbon fibers are embedded in a matrix of metal, which is preferably aluminum. Such composites of carbon fibers and metal have even better temperature resistance and are suitable for even the greatest thermal loads in internal combustion engines.

BRIEF DESCRIPTION OF THE DRAWINGS

One exemplary embodiment of a fuel injection valve of the invention is described herein below, with references to the drawings, in which.

DESCRIPTION OF THE PREFERRED EMBODIMENT

Figure 1:
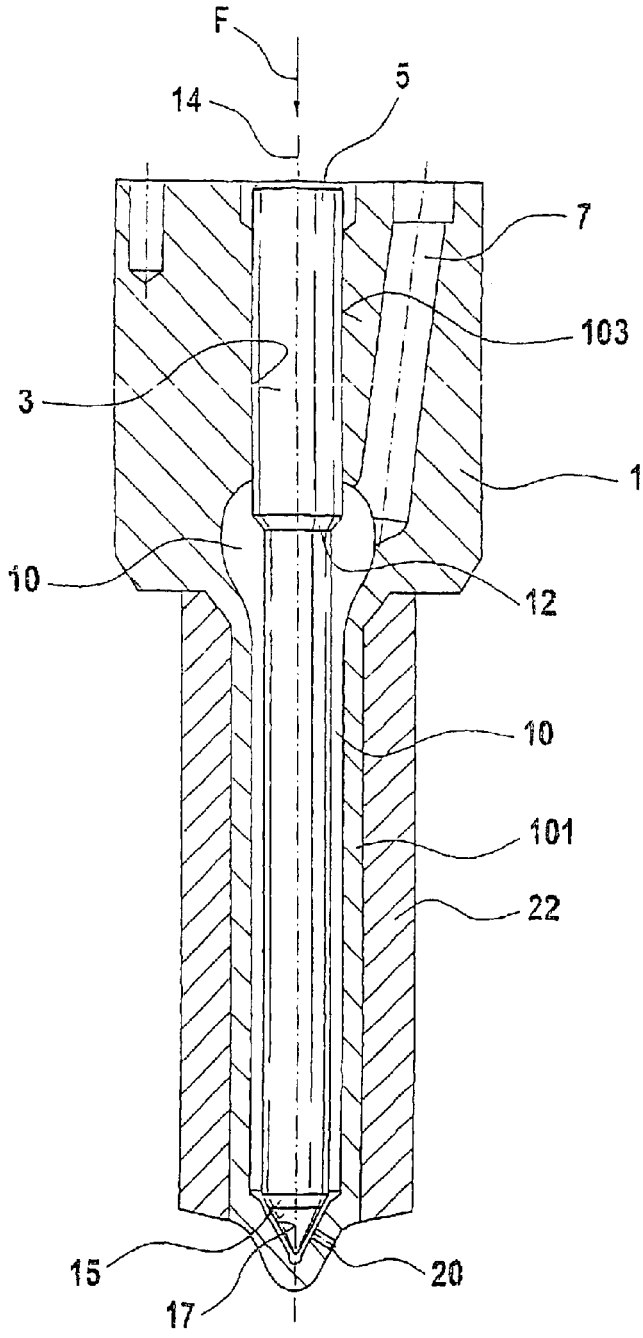
FIG. 1 is a longitudinal section through a injection valve embodying the invention.

In FIG. 1, a longitudinal section is shown through a fuel injection valve of the invention, in its essential region. The fuel injection valve has a valve body 1 with a bore 3, which on its end toward the combustion chamber changes over into a substantially conical valve seat 17. In the end region toward the combustion chamber of the valve body 1, at least one injection opening 20 is embodied, which connects the valve seat 17 with the combustion chamber of the engine. In the bore 3, a valve member 5 is disposed longitudinally displaceably; the valve member 5 is embodied in pistonlike form and is guided in a guide portion 103 of bore 3 on the end remote from the combustion chamber. The valve member 5 narrows from the guide portion 103 toward the combustion chamber, forming a pressure shoulder 12, and on its end toward the combustion chamber, it changes over into a substantially conical valve sealing face 15, which cooperates with the valve seat 17. By means of a radial enlargement of the bore 3 at the level of the pressure shoulder 12, a pressure chamber 10 is formed, which continues in the form of an annular conduit, surrounding the valve member 5, as far as the valve seat 17. Via an inlet bore 7, which is embodied in the valve body 1, the pressure chamber 10 can be filled with fuel at high pressure. The valve member 5 is acted upon, by means of a device not shown in the drawing, with a closing force F, which acts on the face end, remote from the combustion chamber, of the valve member 5 and is oriented toward the valve seat 17. In the drawing, this force F is represented by an arrow. By means of the introduced fuel, which reaches the pressure chamber 10 and is at high pressure, a hydraulic opening force on the pressure shoulder 12 and on parts of the valve sealing face 15 of the valve member 5 results, the hydraulic opening force being oriented counter to the closing force F. If the closing force F in the fuel injection valve is constant, then an injection of fuel into the combustion chamber of the engine takes place once the fuel pressure in the pressure chamber 10 has risen far enough that the hydraulic opening force on the valve member 5 is greater than the closing force F. The valve member 5 is then moved in the longitudinal direction and with the valve sealing face 15 lifts away from the valve seat 17 and thus uncovers the injection opening 20. An interruption in the fuel delivery to the pressure chamber 10 causes the pressure there to drop accordingly again, until the closing force F again predominates, and the valve member 5 moves longitudinally back into its closing position.

The valve body 1 is embodied as essentially rotationally symmetrical on its outside. In the guide region 103, the valve body 1 has a relatively large outer diameter, so as to enable a stable guidance of the valve member 5 and the embodiment of the inlet conduit 7. Toward the combustion chamber, the valve body 1 narrows in its outer diameter and changes over in the region of the pressure chamber 10 to a markedly smaller valve body shaft 101. Around the valve body shaft 101, which is embodied cylindrically on its outside, is a sleeve 22 that rests by nonpositive engagement on the valve body shaft 101. The sleeve 22 is made from a different material from that of the valve body 1, which is made from a steel. The sleeve 22 has anisotropic strength properties, so that in the region of the valve body shaft 101, a greater stiffness in the tangential direction results than is possible for a valve body shaft 101 made from steel.

Because of the high pressure in the pressure chamber 10, which in modern fuel injection systems of the kind used for self-igniting internal combustion engines can amount to from 100 to 200 MPa, the valve body 1 is widened by the fuel pressure, particularly in the region of the valve body shaft 101. This bulging out of the valve body 1 has an adverse effect on the properties of the fuel injection valve. First, the bulging causes a deformation of the valve body 1 in the region of the valve body shaft 101, which essentially represents a radial widening of the bore 3. As a result, the valve body 1 is also deformed in the region of the guide portion 103, so that the guidance of the valve member 5 in the guide portion 103 of the bore 3 changes, which can lead to increased wear there and hence to a reduction in the service life of the fuel injection valve. Second, the bulging of the valve body shaft 101 leads to a change at the valve seat 17. Like the valve sealing face 15, the valve seat 17 is embodied substantially conically. Because of the bulging of the valve body 1 in the region of the valve body shaft 101, the valve seat 17 becomes tilted slightly outward, so that the line of contact of the valve sealing face 15 on the valve seat 17 shifts somewhat. Since the opening pressure of the fuel injection valve depends on the size of the surface area of the valve seat 17 subjected to pressure, this also changes the opening pressure, making precise injection of the fuel at the desired instant more difficult.

Figure 2:
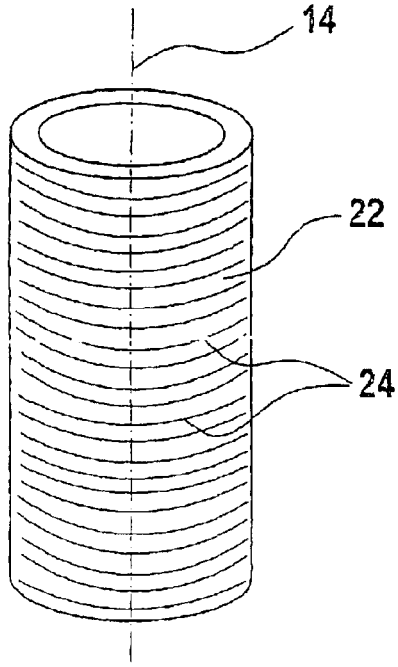
FIG. 2 is an elevation view of the sleeve, showing the course of the fibers.
Figure 3:
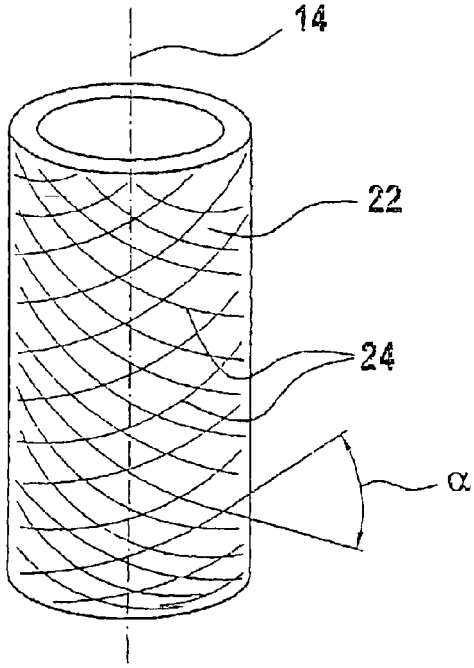
FIG. 3 shows a further exemplary embodiment of the sleeve, with a different arrangement of the fibers.

The sleeve 22 is preferably embodied as a composite material, in which fibers that have a high modulus of elasticity and tensile strength are embedded in a matrix. FIG. 2 shows a sleeve 22 and the course of fibers 24 in the matrix. One possible combination of fibers 24 and matrix is for the fibers 24 to be embodied as carbon fibers and for a matrix of epoxy resin to be used. The carbon fibers sheathed with epoxy resin are wound onto the valve body shaft 101 of the finished fuel injection valve, and the epoxy resin is polymerized there by means of a suitable treatment. As a result, a secure bond of the sleeve 22 with the valve body shaft 101 is obtained, without requiring additional adhesive means or similar joining materials. Because of the carbon fibers 24, the sleeve 22 has a very high modulus of elasticity and a high tensile strength in the tangential direction. The modulus of elasticity of such a composite can be markedly above that of steel. A typical value for the modulus of elasticity of steel is $E=200{,}000\ N/mm^2$, while with carbon-fiber and epoxy-resin composites, moduli of elasticity of $300{,}000\ N/mm^2$ and more can be achieved. In the embodiment of FIG. 2, no fibers extend in the longitudinal direction of the sleeve 22, and so both the modulus of elasticity and the tensile strength in the longitudinal direction, that is, along the longitudinal axis 14, is less by a factor of approximately 100 than in the tangential direction. Since in a valve body 1 with a reinforcing sleeve 22 the valve body shaft 101 is embodied with thinner walls than in a conventional fuel injection valve, the valve body shaft 101 also has low stiffness in the longitudinal direction. Because of the low modulus of elasticity of the sleeve 22 in the longitudinal direction, the result is low stiffness in the entire region of the valve body shaft 101 in the longitudinal direction. This leads to a further advantage of the fuel injection valve. since in its closing motion, the valve member 5 with its valve sealing face 15 strikes the valve seat 17 hard and is braked there over the shortest possible distance. Because of the reduction in stiffness of the valve body 1 in the axial direction in the region of the valve body shaft 101, the braking travel lengthens, and thus the requisite braking force on the valve member 5 is reduced, which leads to a lesser mechanical load in the region of the valve seat 17 and thus to reduced wear in this region.

However, it may also be desired that the sleeve 22 have a higher modulus of elasticity in the longitudinal direction than it would have solely from the matrix material of the composite material. To that end, various layers of fibers may be disposed in the sleeve 22, forming an angle $\alpha$ with one another. In this way, the ratio of tangential stiffness to stiffness in the longitudinal direction of the sleeve 22 can be determined quite precisely, and the desired stiffness can be achieved as a function of the angle and of the number of fibers. For such composites, a typical angle $\alpha$ is from 5° to 30°; preferably, the angle of 10° is employed.

Besides the combination of carbon fibers and epoxy resin, other combinations of fibers and matrix material are also possible. For instance, carbon fibers can also be embedded in a matrix of graphite, which has the advantage that the composite comprising graphite and carbon fibers resists markedly higher temperatures than an epoxy-resin and carbon-fiber composite. Graphite resists temperatures of 200° C. to 300° C., so that this combination is particularly well suited to use in fuel injection valves, which are exposed to the heat of combustion in the combustion chamber of the engine. It is also possible for the carbon fibers to be embedded in a matrix of metal. To that end, for instance aluminum or other low-melting metals into which carbon fibers can be bound are suitable. Sleeves with a metal or graphite matrix of this kind are preferably manufactured separately from the valve body 1 and then shrink-fitted onto the valve body 1, in order to achieve a nonpositive-engagement connection of the sleeve 22 and the valve body 1.

Besides carbon fibers, various other fibers can also be employed, for instance polymer fibers such as aramide or glass fibers. Which type of fiber is used in combination with which matrix material depends on the use of the fuel injection valve, the temperatures that occur, and the expected pressures, and hence on the mechanical loads in the shaft region 101 of the fuel injection valve.

The foregoing relates to preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a valve body (1) in which a bore (3) is embodied that has a longitudinal axis (14) and on the end of which bore toward the combustion chamber a valve seat (17) is embodied, at least one injection opening (20) disposed in the region of the valve seat (17), the at least one opening (20) connecting the bore (3) with the combustion chamber of the engine, a valve member (5) disposed longitudinally displaceably in the bore (3), the valve member 5 having a sealing face (15) cooperating with the valve seat (17) to control the a least one injection opening (20), a pressure chamber (10) which is embodied between the wall of the bore (3) and the valve member (5), which pressure chamber can be filled with fuel at high pressure, and a sleeve (22) having anisotropic strength properties surrounding the valve body (1) in the region of the pressure chamber (10).

2. The fuel injection valve of claim 1, wherein the sleeve (22) is embodied as a hollow cylinder having a cylindrical inner face, with the entire inner face resting by positive engagement on the valve body (1).

3. The fuel injection valve of claim 1, wherein the sleeve (22) has a greater tensile strength in the tangential direction, relative to the longitudinal axis (14) of the bore (3), than in the longitudinal direction.

4. The fuel injection valve of claim 1, wherein the valve body (1) is made from steel, and wherein that the sleeve (2) has a greater tensile strength in the tangential direction than does the valve body (1).

5. The fuel injection valve of claim 1, wherein the sleeve contains fibers (24), at least some of which fibers extend at least approximately in the tangential direction relative to the longitudinal axis (14) of the bore (3).

6. The fuel injection valve of claim 5, wherein the fibers (24) are carbon fibers.

7. The fuel injection valve of claim 5, wherein the carbon fibers (24) are embodied in a matrix of epoxy resin.

8. The fuel injection valve of claim 6, wherein the carbon fibers (24) are embodied in a matrix of graphite.

9. The fuel injection valve of claim 6, wherein the carbon fibers (24) are embedded in a matrix of metal.

10. The fuel injection valve of claim 9, wherein the metal is aluminum.

* * * * *